US008388465B2

(12) United States Patent
De La Cruz et al.

(10) Patent No.: US 8,388,465 B2
(45) **Date of Patent: *Mar. 5, 2013**

(54) GOLF CLUB HAVING REMOVEABLE SOLE WEIGHT

(75) Inventors: Noah De La Cruz, Carlsbad, CA (US); Charles E. Golden, Carlsbad, CA (US); Peter L. Soracco, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 391 days.

This patent is subject to a terminal disclaimer.

(21) Appl. No.: 12/760,799

(22) Filed: Apr. 15, 2010

(65) Prior Publication Data

US 2010/0197426 A1 Aug. 5, 2010

Related U.S. Application Data

(63) Continuation-in-part of application No. 12/263,532, filed on Nov. 3, 2008, now Pat. No. 7,758,452.

(51) Int. Cl.
*A63B 53/04* (2006.01)
*A63B 53/06* (2006.01)

(52) U.S. Cl. ..... 473/334; 473/335; 473/338; 473/344; 473/349

(58) Field of Classification Search ..... 473/324–350, 473/287–292, 256
See application file for complete search history.

(56) References Cited

U.S. PATENT DOCUMENTS

| | | | | |
|---|---|---|---|---|
| 4,150,464 | A | 4/1979 | Tracy | |
| 5,720,674 | A | 2/1998 | Galy | |
| 5,794,316 | A | 8/1998 | Anscher | |
| 6,458,044 | B1 | 10/2002 | Vincent et al. | |
| 6,648,772 | B2 | 11/2003 | Vincent et al. | |
| 6,668,428 | B2 | 12/2003 | Moeller | |
| 6,860,818 | B2 | 3/2005 | Mahaffey et al. | |
| 6,902,432 | B2 | 6/2005 | Morikawa et al. | |
| 7,186,190 | B1 | 3/2007 | Beach et al. | |
| 7,419,441 | B2 | 9/2008 | Hoffman et al. | |
| 7,758,452 | B2 * | 7/2010 | Soracco | 473/334 |
| 7,871,336 | B2 * | 1/2011 | Breier et al. | 473/244 |
| 7,967,699 | B2 * | 6/2011 | Soracco | 473/334 |
| 8,092,316 | B2 * | 1/2012 | Breier et al. | 473/244 |
| 8,105,175 | B2 * | 1/2012 | Breier et al. | 473/244 |
| 2007/0105646 | A1 | 5/2007 | Beach et al. | |
| 2009/0143167 | A1 | 6/2009 | Evans | |

* cited by examiner

*Primary Examiner* — Sebastiano Passaniti
(74) *Attorney, Agent, or Firm* — Michael J. Mancuso

(57) ABSTRACT

A golf club head is presented comprising a sole including a weight member secured to the sole via a non-threaded attachment assembly. Further, the weight member has a large surface area relative to its thickness, resulting in a chip-like or wafer-like weight member. This design allows the mass of the weight member to be spread substantially along the surface of the sole as opposed to in the interior of the club head. The golf club head may comprise more than one weight member.

18 Claims, 15 Drawing Sheets

GOLF CLUB HAVING REMOVEABLE SOLE WEIGHT

CROSS-REFERENCE TO RELATED APPLICATIONS

This application is a continuation-in-part of U.S. patent application Ser. No. 12/263,532, filed Nov. 3, 2008 now U.S. Pat. No. 7,758,452, which is incorporated in its entirety by reference herein.

FIELD OF THE INVENTION

The invention relates to golf clubs, and more particularly, to metal wood and utility-type golf clubs having dynamic mass properties.

BACKGROUND OF THE INVENTION

Wood and utility-type golf club heads generally include a front or striking face, a crown, a sole, and an arcuate skirt including a heel, a toe, and a back. The striking face interfaces with and contacts the golf ball. A plurality of grooves, sometimes referred to as "score lines," may be provided on the face to assist in imparting spin to the ball and for decorative purposes. The crown is generally configured to have a particular look to the golfer and to provide structural rigidity for the striking face. The sole of the golf club contacts and interacts with the ground during the swing.

With a high percentage of amateur golfers constantly searching for more distance on their shots, particularly their drives, the golf industry has responded by providing golf clubs specifically designed with distance and accuracy in mind. The head sizes of wood-type golf clubs have increased, allowing the club to possess a higher moment of inertia (MOI), which translates to a greater ability to resist twisting on off-center hits. Generally, as wood-type club head becomes larger, its center of gravity will be moved back away from the face and further toward the toe, resulting in hits flying higher and further to the right than expected (for right-handed golfers). Reducing the lofts of the larger head clubs can compensate for this. Because the center of gravity is moved further away from hosel axis, the larger heads can also cause these clubs to remain open on contact, thereby inducing a "slice" effect (in the case of a right-handed golfer the ball deviates to the right). Offsetting the head and/or incorporating a hook face angle can help compensate for this by "squaring" the face at impact, but often more is required to eliminate the "slice" tendency.

Another technological breakthrough in recent years to provide the average golfer with more distance is to make larger head clubs while keeping the weight constant or even lighter by casting consistently thinner shell thicknesses and using lighter materials such as titanium, magnesium, and composites. Also, the faces of the clubs have been steadily becoming thinner, because a thinner face will maximize what is known as the coefficient of restitution (COR) from impacts with golf balls. The more a face rebounds upon impact, the more energy is imparted to the ball, thereby increasing the resulting distance that the ball travels.

Known methods to enhance the weight distribution of wood-type club heads to help reduce the club from being open upon contact with the ball usually include the addition of weights to the body casting itself or strategically adding a weight element at some point in the club. Efforts to incorporate weight elements into the wood-type club head are discussed in the patent literature. For instance, U.S. Pat. No. 7,186,190 discloses a golf club head comprising a number of moveable weights attached to the body of the club head. The club head of the '190 includes a number of threaded ports into which the moveable weights are screwed. Though the mass characteristics of the golf club may be manipulated by rearranging the moveable weights, the cylindrical shape of the weights and their placement within the golf club body necessarily moves a significant portion of the mass toward the center of the club head, which may not maximize the peripheral weight of the club head or the MOI. Moreover, most cylindrical weight members are attached to the club head via threaded engagement; during normal play, the cylindrical weights may rotate and become unintentionally disengaged from the club head.

As previously stated, a concern for higher handicap golfers is the tendency to "slice," which in addition to deviating the ball to the right also imparts a greater spin to the ball, further reducing the overall ball distance. To reduce this tendency, the '190 patent teaches the placement of weight elements directly into the club head. The placement of weight elements is designed so that the spin of the ball will be reduced, and also a "draw" (a right-to-left ball flight for a right-handed golfer) will be imparted to the ball flight. This ball flight pattern is also designed to help the distance-challenged golfer because a ball with a lower spin rate will generally roll a greater distance after initially contacting the ground than would a ball with a greater spin rate.

Alternative approaches for moving the center of gravity of a golf club head rearward and downward in the club head utilize composite structures. These composite structures utilize two, three, or more materials that have different physical properties including different densities. By positioning materials that provide the desired strength characteristics with less weight near the crown or top line of a golf club head, a larger percentage of the overall weight of the golf club head is shifted towards the sole of the club head. This results in the center of gravity being moved downward and rearward. This approach is advantageously applicable to muscle back iron clubs or fairway woods, as this will help to generate loft and power behind and below the ball. An example of this type of composite club head is shown in U.S. Pat. No. 5,720,674. The club head of the '674 patent comprises an arcuate portion of high-density material bonded to a recess in the back-skirt. Because composite materials like those found in the '674 club head must be bonded together, for example by welding, swaging, or using bonding agents such as epoxy, they may be subject to delamination or corrosion over time. This component delamination or corrosion results in decreased performance in the golf club head and can lead to club head failure.

Though many methods of optimizing the mass properties of golf club heads exist, there remains a need in the art for a golf club head comprising at least a movable weight a having secure attachment means and a low-profile such that the weight does not protrude into the center of the club head and negatively affect the location of the center of gravity.

SUMMARY OF THE INVENTION

The present invention is directed to a metal wood or utility-type golf club head having a sole comprising at least one removable weight member. The removable weight member is preferably located toward the back of the sole and may be substantially centered between the heel and toe of the club head. Alternatively, the removable weight member may be situated toward the back and heel or toward the back and toe of the club head, depending on the desired mass characteristics, e.g., center of gravity, loft and moment of inertia, of the club head. Preferably, the weight members are connected to the club head by non-threaded means.

The removable weight member has an area or areas of concentrated mass along its plan area (PA), or surface area. These areas of concentrated mass may be situated at any location along the plan area of the weight member, depending on the desired mass characteristics of the club head. Alternatively, the area(s) of concentrated mass can be concurrent with the PA.

The removable weight member also has a low profile preferably to match the curvature or to the surface of the sole. The PA of the weight member is preferably significantly greater than its thickness, resulting in a weight member that resembles a thin chip or wafer. This design allows the mass added by the weight member to be spread substantially along the surface of the sole, as opposed to the interior of the club head, and maintains the center of gravity of the club head below and behind the center of the hitting face.

Removable weight members of the present invention may be attached to the sole via a number of different non-threaded mechanisms. In one embodiment, a removable weight member comprises a projection containing a spring-loaded bar. Pins on either side of the spring-loaded bar engage holes in a receiving cavity of the sole to securely but releasably connect the weight member to the sole. The weight member body further comprises a dovetail which is slidably inserted into a dovetail receptacle on the sole. To remove the weight member, a tool resembling pliers may be used to depress the pins on the spring-loaded bar and the weight member may be pulled free of the receiving cavity. In another embodiment, a removable weight member may attach to the sole via a side-release buckle mechanism. In yet another embodiment, a removable weight member may attach to the sole via a universal-serial-bus (USB) connection assembly.

The removable weight member preferably comprises a material having a density greater than the density of the material comprising the sole. Alternatively, the removable weight member may comprise the same material as the sole, however having a greater thickness than the average thickness of the sole. The removable weight member may comprise metals, e.g. titanium, stainless steel, or tungsten, composite or polymeric material. The removable weight member may alternatively comprise any material having a density appropriate to optimize the mass characteristics of the club head.

DETAILED DESCRIPTION

The golf club head of the present invention is preferably a metal wood or utility-type club head comprising a hosel, hitting face, crown, sole, and skirt disposed between the crown and sole. The golf club of the present invention further comprises a back, opposite the hitting face, and a heel and toe portion. The inventive golf club head also has a flat profiled weight member or chip disposed proximate to the back of the club head.

Figure 1:
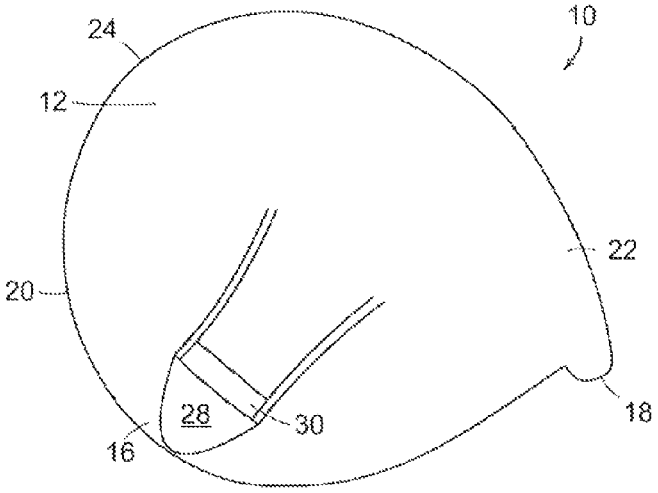
FIG. 1 is a bottom plan view of a golf club head of the present invention including a removable weight member.

An exemplary club head is shown FIG. 1. Club head 10 comprises sole 12, a crown (not shown), back 16, hosel 18, skirt 20, heel 22, toe 24, hitting face 26 (not shown) and movable weight chip 28. Sole 12 further comprises docking station 30, into which movable weight chip 28 is received and fixedly attached. Docking station 30 is preferably located substantially toward back 16 in order to position chip 28 behind and below the geometric center of club head 10. The inclusion of weight chip 28 in this location allows the center of gravity of the club head to be rearward of and lower than the center of hitting face 26, which in turn provides for greater loft and a larger "sweet spot." In addition, the moment of inertia (MOI) of the club head in the vertical direction through the geometric center of the center of gravity of the club head is increased relative to the MOI of a club head comprising a sole having a constant density, reducing distance and accuracy penalties associated with off-center hits.

Figure 3:
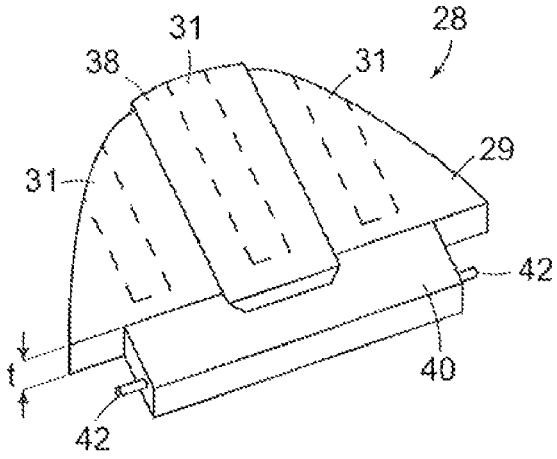
FIG. 3 is a perspective view of the weight member shown in FIG. 1.
Figure 4:
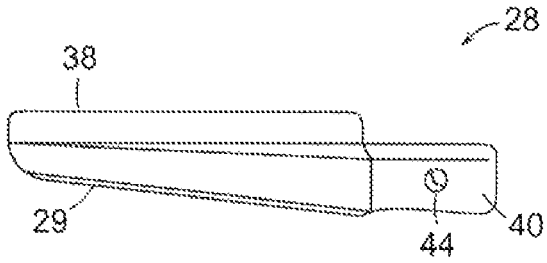
FIG. 4 is a side plan view of the weight member of FIG. 3.
Figure 5:
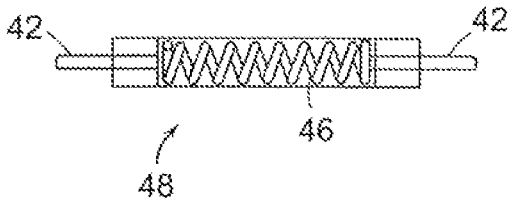
FIG. 5 is a top plan view of a spring-loaded bar with the top surface removed to show the interior of the part.
Figure 6:
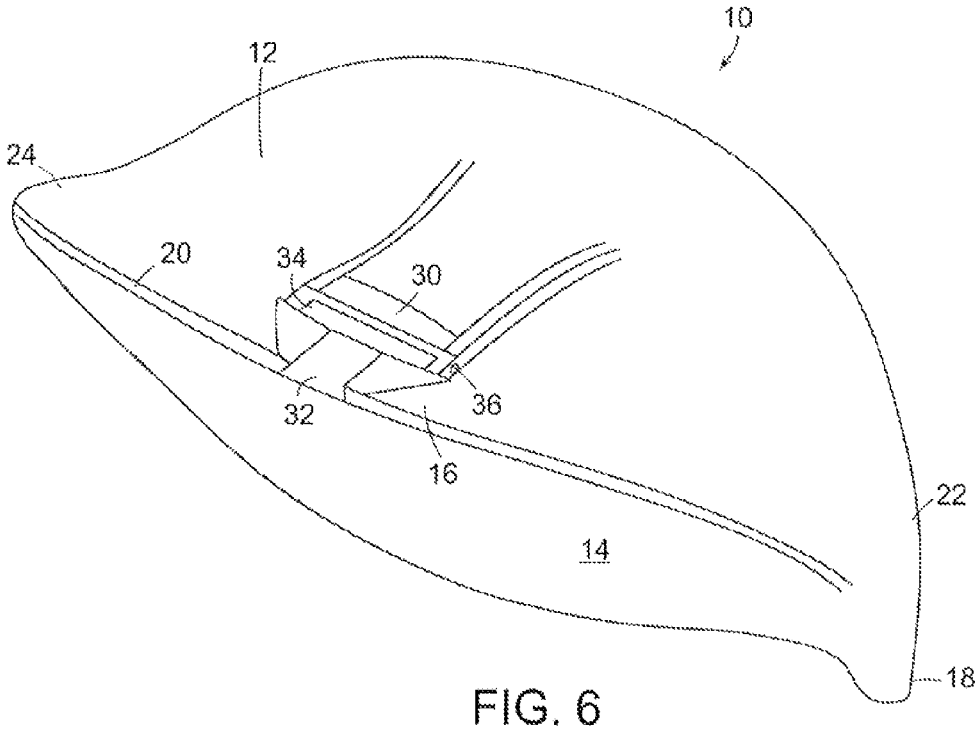
FIG. 6 is a perspective view of the golf club head of FIG. 2.

In accordance with this embodiment, docking station 30 may be raised relative to the surface of sole 12 in order to provide room for the attachment mechanism responsible for fixedly attaching weight chip 28 to docking station 30. In other embodiments of the present invention, docking station 30 may be flush with the surface of sole 12. Docking station 30 can be more clearly seen in FIGS. 2 and 6. In both figures, club head 10 is shown without weight chip 28. Referring to FIG. 6, docking station 30 comprises dovetail receptacle 32, cavity 34 and bores 36 located on either side. According to this embodiment, weight chip 28 attaches to docking station 30 similar to the attachment of a watchband to a watch face. Dovetail 38 of weight chip 28, shown in FIGS. 3 and 4, is inserted into dovetail receptacle 32 of docking station 30. The resulting dovetail joint prevents weight chip 28 from lifting out of docking station 30. To more securely attach weight chip 28, projection 40 on the chip is inserted into cavity 34. Tube 44 disposed within projection 40 contains spring-loaded bar 48, which in turn comprises spring 46 connected to pins 42. With spring-loaded bar 48 loaded into tube 44, projection 40 is inserted into cavity 34 by first inserting one side of projection 40 at an angle such that a first pin 42 engages a first bore 36 in cavity 34. With first pin 42 engaged, second pin 42 is manually depressed, for instance with the blade of a pocket knife, and the other side of projection 40 is inserted into cavity 34. The device depressing second pin 42 is moved away as the other side of projection 40 is entering cavity 34 so as to allow second pin 42 to release and engage second bore 36, in the same manner that a watch band is attached to a watch face. Spring-loaded bar 48 may also include elastomeric rod, which can replace spring 46.

Figure 7:
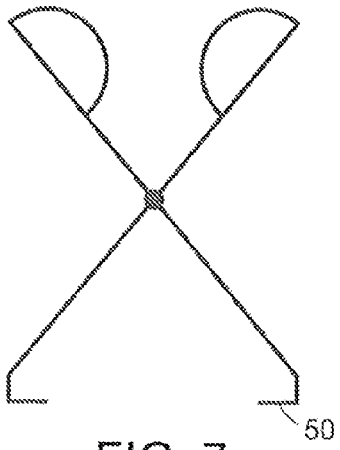
FIG. 7 is a top plan schematic view of a tool used to remove a weight member from a golf club head of the present invention.

To remove weight chip 28 from docking station 30, a tool, such as the one shown schematically in FIG. 7, may be used to disengage pins 42 from bores 36. The tool may be similar to a plier and may comprise pincers 50. A user opens the tool to position pincers 50 on either side of bores 36, then squeezes the tool at the handle to engage pincers 50 in bores 36. Pincers 50 are sized and dimensioned to depress pins 42 so that they are no longer engaged in bores 36. Weight chip 28 may then be slidably removed from docking station 30.

Weight chip 28 may also be retained by one or more set screws that threadedly engage projection 40 through the sole or through docking station 30. Weight chip 28 may be removed by removing the set screw with an Allen-wrench or screwdriver. Weight chip may also have one spring-loaded locking arm that can lock to a cavity or depression within docking station 30. The spring-loaded locking arm may have a live-joint action to provide the springiness to the arm.

Unlike the moveable weight members of the prior art that utilize cylindrical weights housed in ports that have been formed into the body of the club head, weight chip 28 has a low profile, allowing its weight to be spread substantially along the surface of sole 12. The attachments means of weight chip 28, i.e. dovetail receptacle 32 and cavity 34, are located substantially on the surface of sole 12, as opposed to in the interior of the club head. This configuration allows the center of gravity to remain behind and below the geometric center of the hitting face and more efficiently increases MOI, as mass is located at the maximum distance from the axis of rotation of the club head, as illustrated in Table 1 below. Cylindrical weight members housed in ports or cavities formed in the body of the club head, such as those disclosed in U.S. Pat. No. 7,186,190, are necessarily located on the interior of the club head and thus closer to the geometric center or center of gravity, and hence cannot increase MOI as efficiently. Further, the cavities themselves comprise a housing which adds mass to the interior of the club head, once again drawing the center of gravity toward the center of the club head and hindering the optimization of the MOI. Furthermore, the inventive attachment means do not use threaded connectors, as discussed herein.

Figure 10:
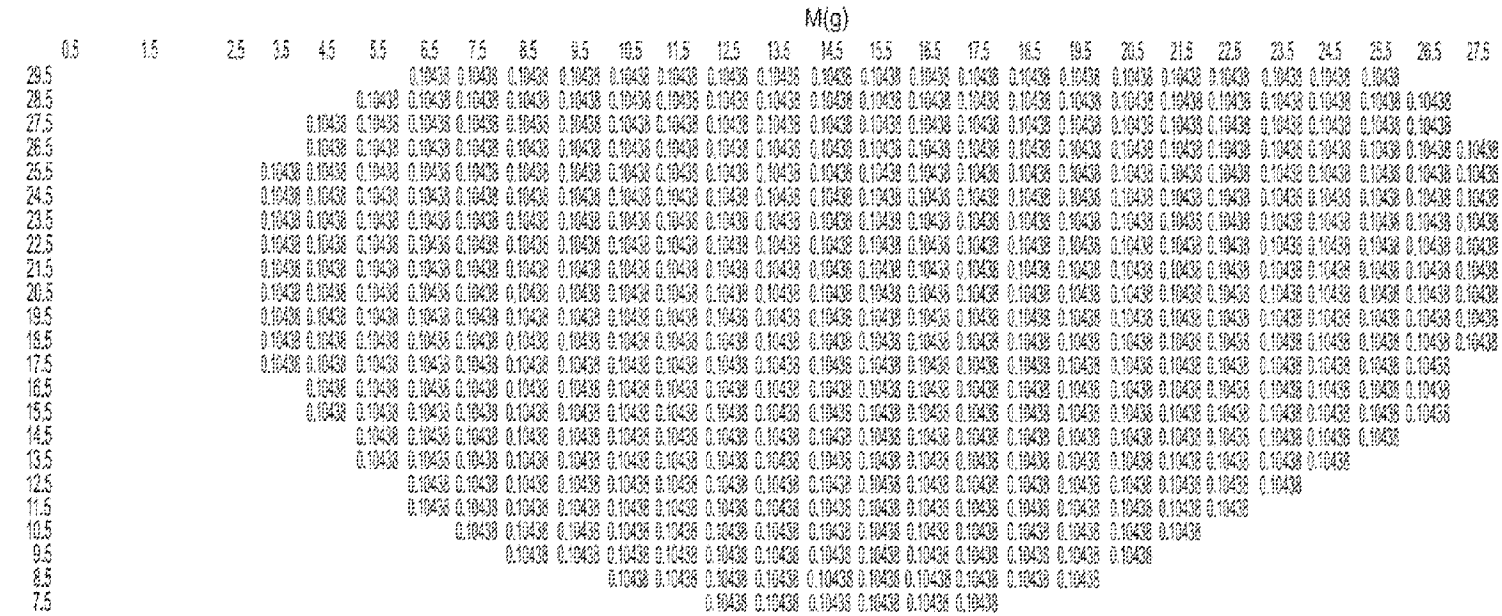
FIG. 10 is a two-dimensional numerical model of a golf club head sole having a constant density.

An exemplary two-dimensional sole is modeled in FIGS. 10-15. The sole has a surface area of 215.5 $cm^2$ and a mass of 50.0 g in each of the models illustrated in FIGS. 10-15. FIG. 10 shows a sole having a constant density, in which 50.0 g are spread evenly between the 479 cells which make up the model. The calculated MOI of the sole of FIG. 10 is 9,357.7 $g \cdot cm^2$. In FIGS. 11-14 the sole includes a discrete area of concentrated mass, each discrete area totaling 5.0 g but having various shapes and plan areas (PA).

Figure 19A:
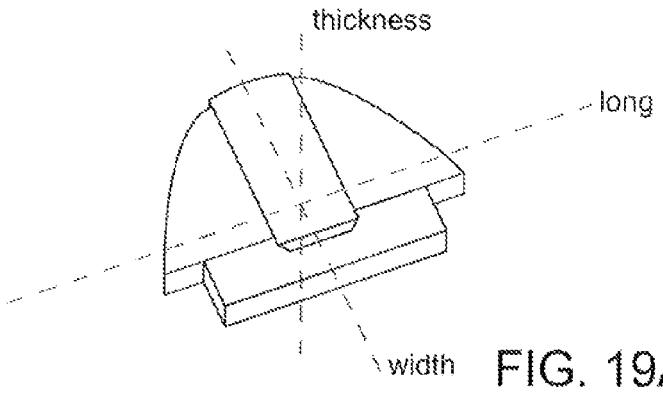
FIGS. 19A and 19B are perspective views of the inventive removable weight members relative to a three-dimensional reference system.
Figure 19B:
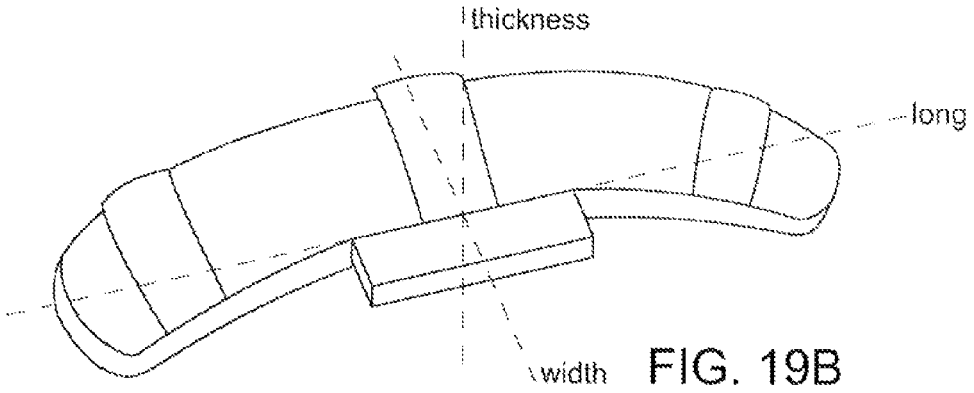
Figure 19C:
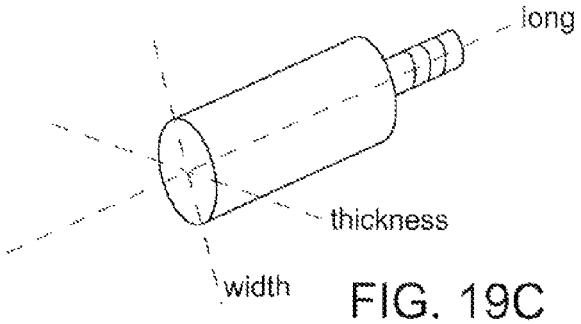
FIG. 19C (Prior Art)
FIG. 19C is a perspective view of a conventional weight insert relative to the same reference system.

PA is defined with reference to FIGS. 19A-19C, and a three-dimensional reference Cartesian coordinate system. Weight inserts including weight chip 28 are three-dimensional objects. As used herein, the dimension with the longest length shall be defined as the longitudinal axis and two orthogonal axes are defined relative to the longitudinal axis. The longer length of these two orthogonal axes shall be the width axis and the shorter length shall be the thickness axis. The PA is the maximum amount of two-dimensional surface that is projected on to a plane defined by the longitudinal axis and width axis of the weight chip as a stand-alone entity without reference to the club head. FIG. 19A shows inventive weight chip 28 relative to this definition. FIG. 19B shows inventive weight chip 328 discussed below relative to this definition, and FIG. 19C shows a conventional cylindrical weight insert with a threaded connection relative to this definition.

The effective thickness of the weight insert is defined as $$t_{eff} = \text{Volume of insert/PA}$$

In accordance with the position of weight chip 28 in FIG. 1, each discrete area of mass in FIGS. 11-14 is located toward the back of the sole and substantially centered between the heel and toe. FIG. 15 is a 2-D representation of a golf club's sole incorporating a conventional cylindrical weight, such as the one illustrated in FIG. 19C, disposed within the club head, as discussed above. Though the model of FIG. 15 provides values for a 2-D sole, it suggests strongly that a cylindrical weight member disposed toward the center of the club head, as shown in FIG. 15 and as seen in the prior art, does not increase MOI as effectively as the inventive mass distributions shown in FIGS. 11-14 and disclosed herein.

The following table summarizes the mass characteristics of the sole modeled in FIGS. 10-15 and illustrates the increase in MOI achieved by concentrating mass in the periphery of the sole, away from the center of gravity and axis of rotation of the club head. Table 1 provides the mass (m) of the discrete area of concentrated mass located on the inventive sole, the plan area (PA) of the discrete area of concentrated mass, the mass (m) of each cell that comprises the discrete area of concentrated mass, and the moment of inertia (MOI) of the entire sole.

TABLE 1

Figure 11:
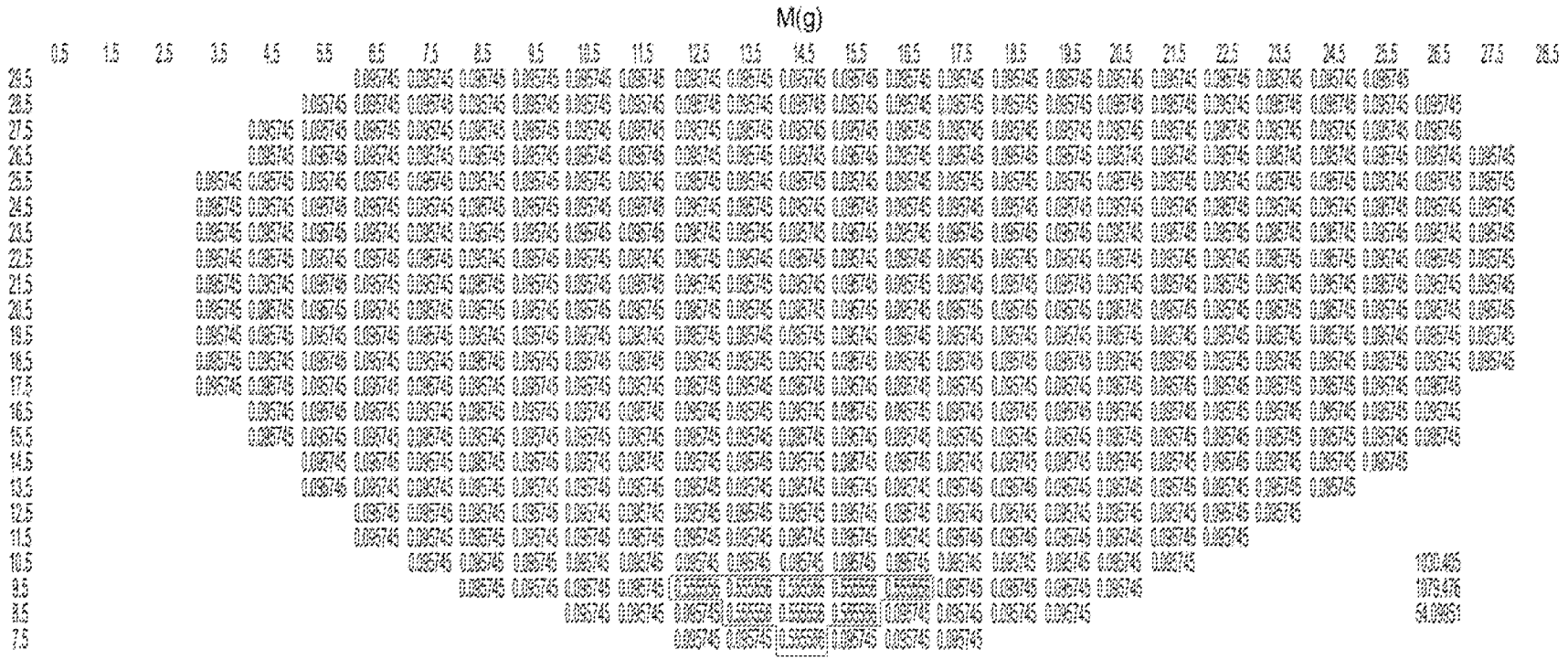
FIGS. 11-15 are two-dimensional numerical models of a golf club head sole having concentrations of mass located toward the back and substantially centered with respect to the heel and toe.
Figure 12:
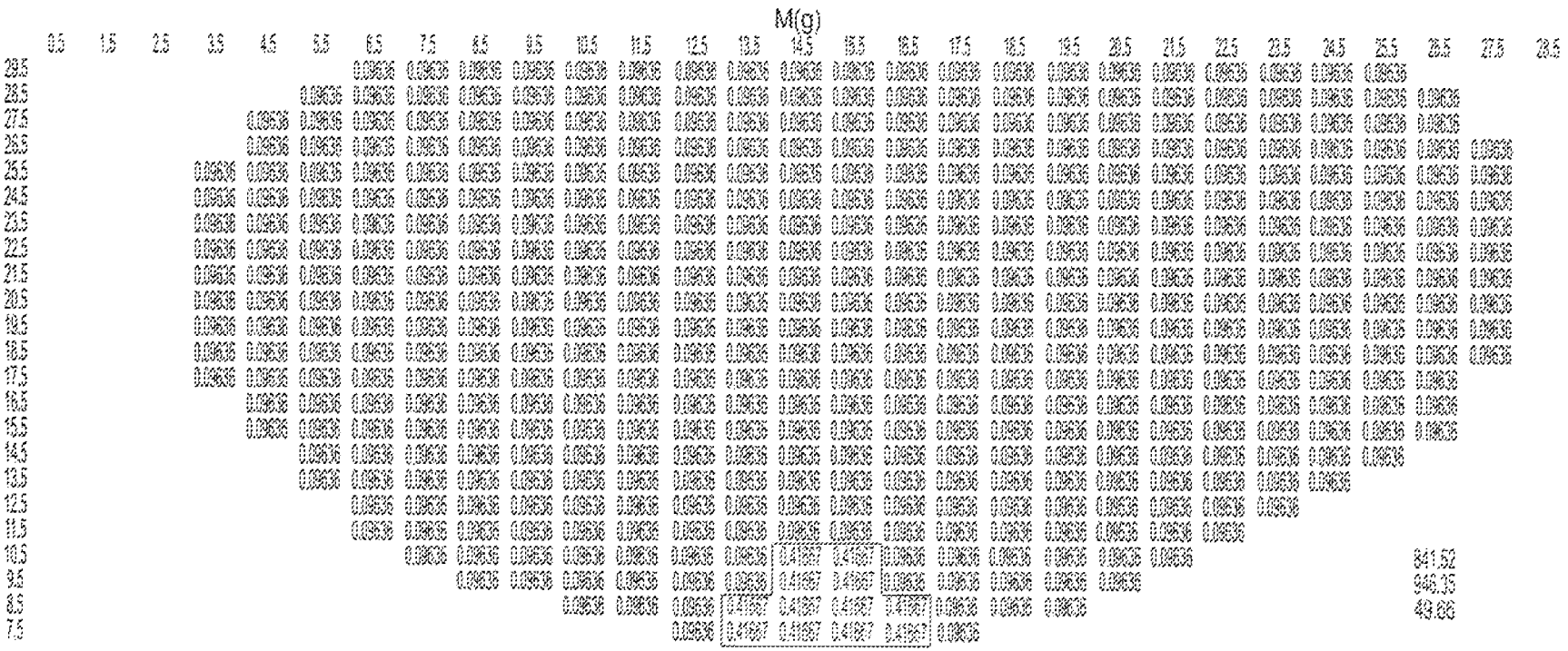
Figure 13:
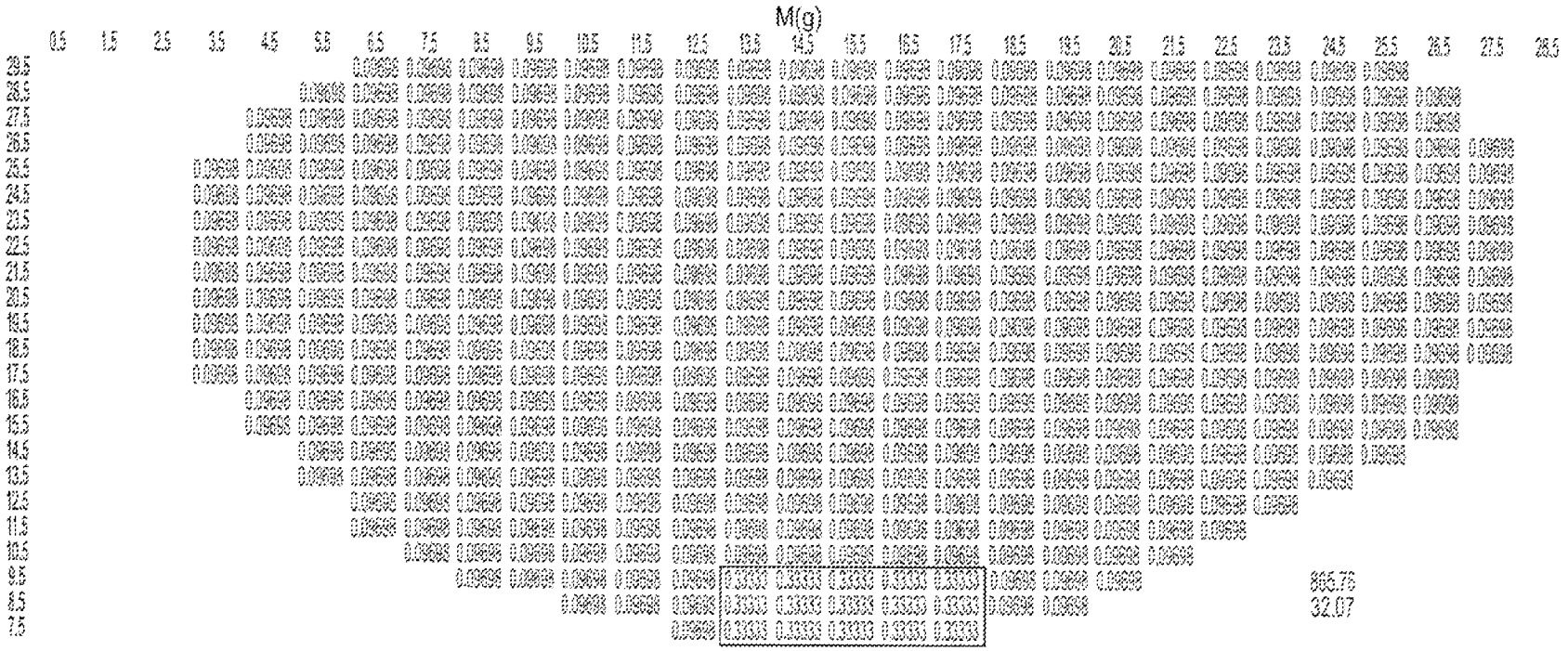
Figure 14:
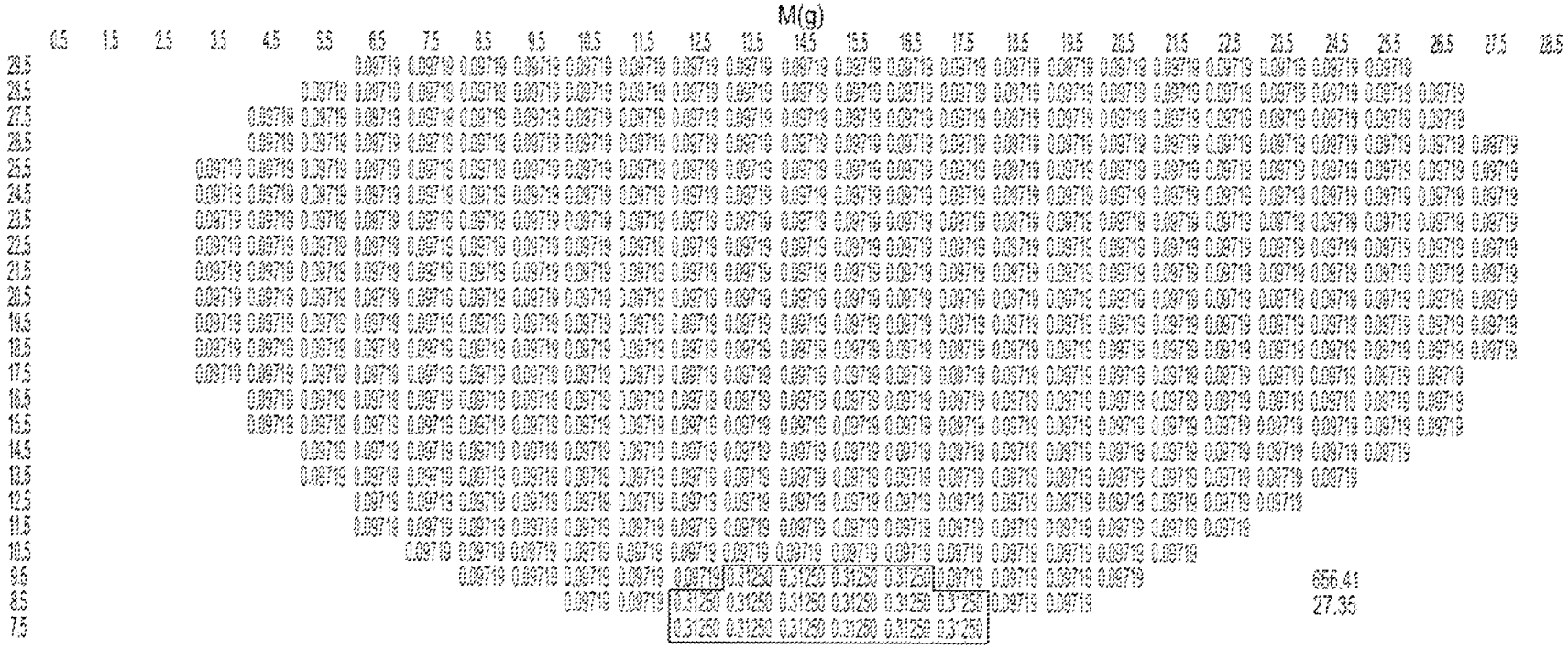
Figure 15:
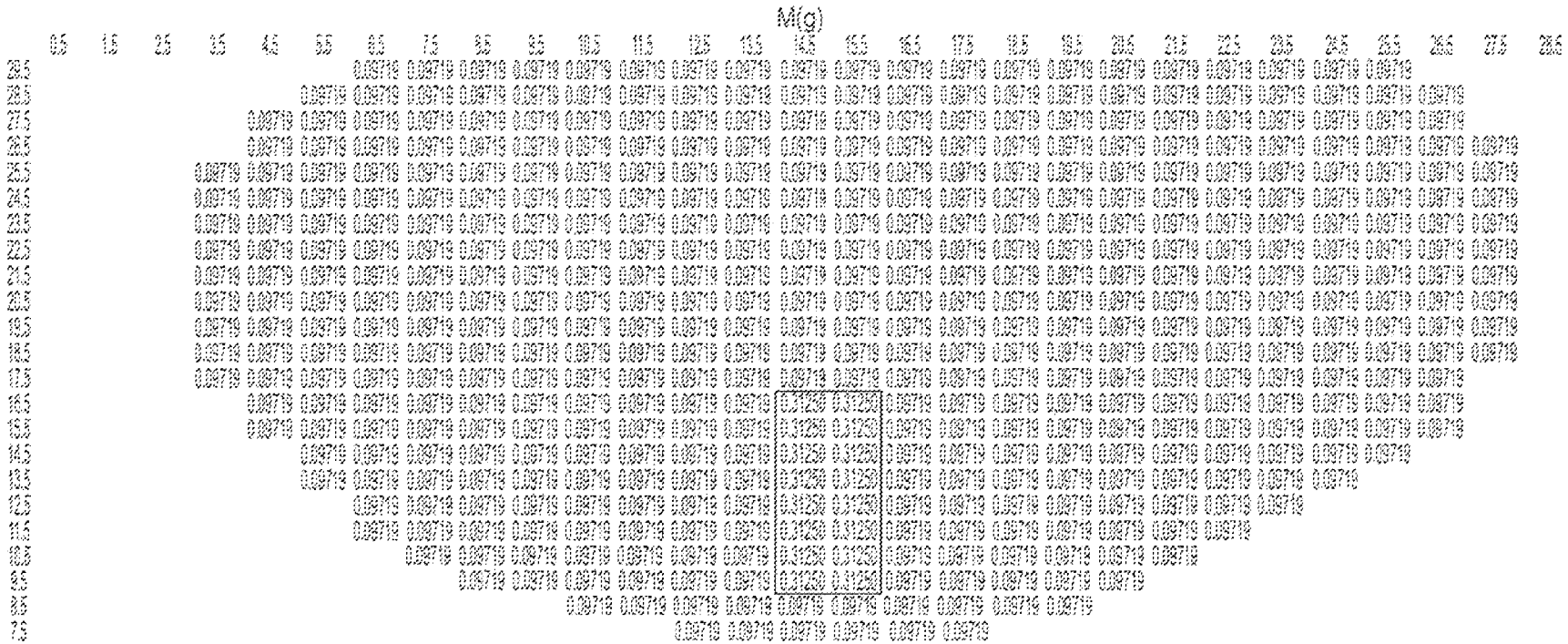

| | m(discrete area) [g] | PA(discrete area) [$cm^2$] | m per cell of discrete area [g] | MOI [$g*cm^2$] |
|---|---|---|---|---|
| FIG. 10 (uniform mass distribution) | — | — | — | 9,357.70 |
| FIG. 11 | 5.0 | 4.05 | 0.56 | 10,382.12 |
| FIG. 12 | 5.0 | 5.40 | 0.42 | 10,368.86 |
| FIG. 13 | 5.0 | 6.75 | 0.33 | 10,328.64 |
| FIG. 14 | 5.0 | 7.20 | 0.31 | 10,332.26 |
| FIG. 15 (cylindrical weight insert) | 5.0 | 7.20 | 0.31 | 9,522.18 |

Figure 20:
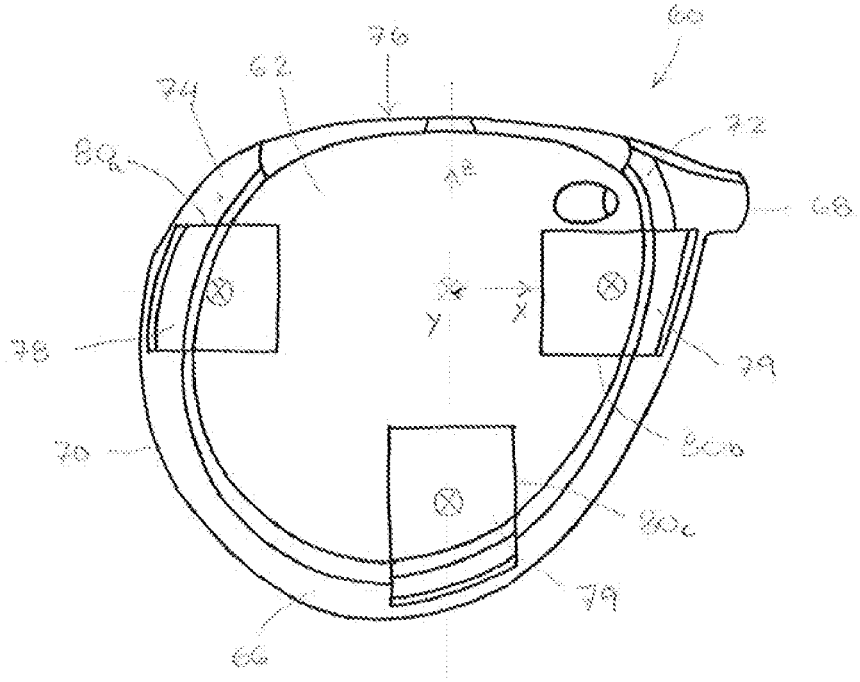
FIG. 20 is a bottom view of a golf club head of the present invention including a plurality of weight members.
Figure 21:
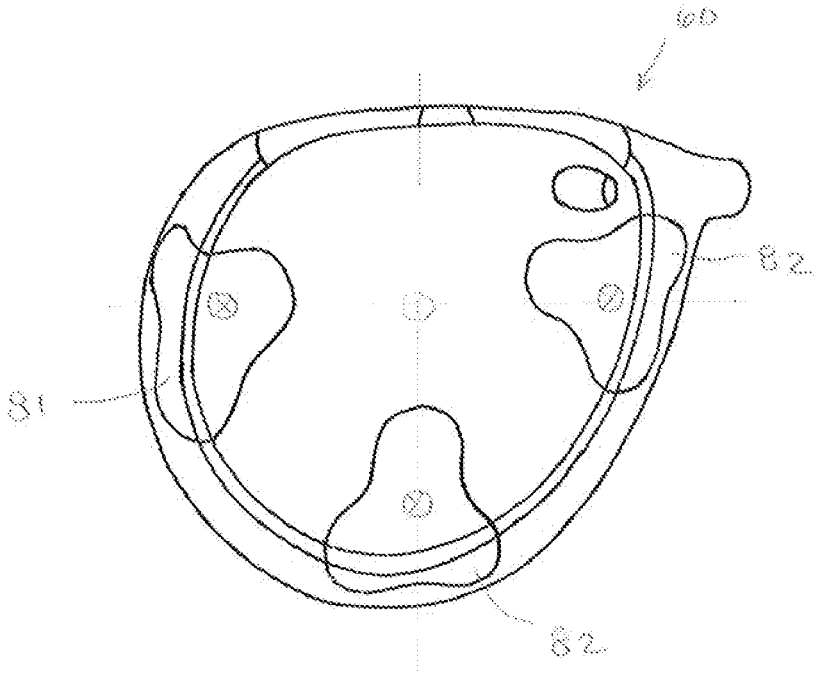
FIG. 21 is a bottom view of another embodiment of a golf club head of the present invention including a plurality of weight members.
Figure 22:
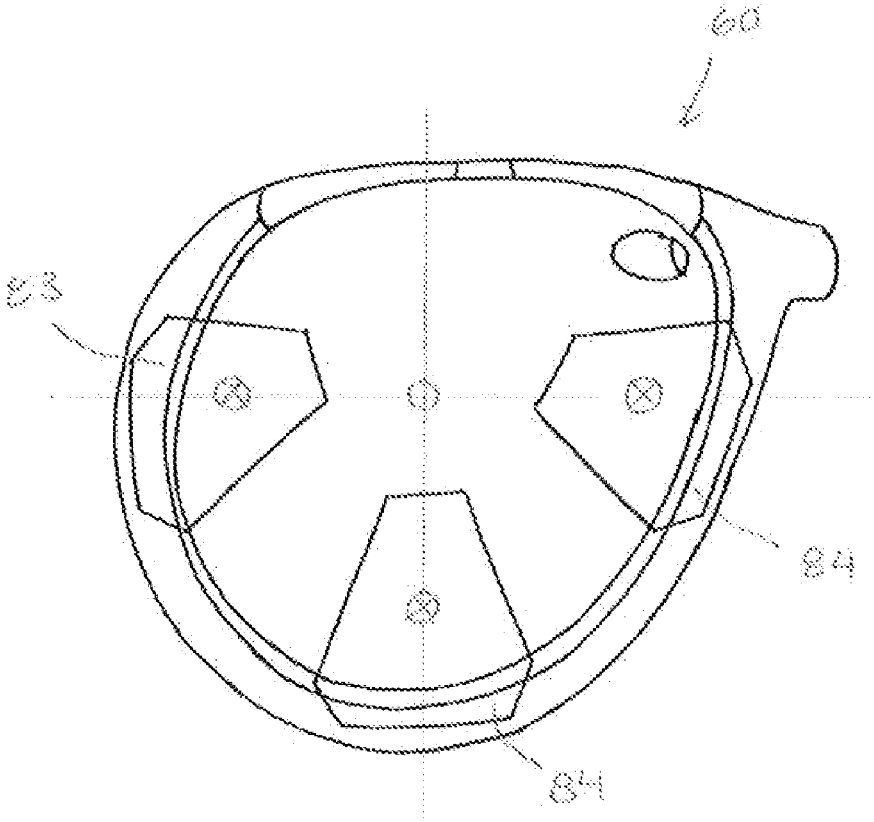
FIG. 22 is a bottom view of yet another embodiment of a golf club head of the present invention including a plurality of weight members.

Alternatively, weight chip 28 and docking station 30 can be located elsewhere on club head 10. For example, weight chip 28 and docking station 30 can be located at the heel, toe or the back of the club head. Furthermore, a plurality of weight chips 28 and docking stations 30 can be utilized and located around the club head, as shown in FIGS. 20-22. More specifically, a number of docking stations 30 can be located proximate the heel, toe and back, and one weight chip 28 (or more) can be selectively deployed at any of the available docking stations to alter the mass characteristics of the club head. The unused docking stations can be filled with "dummy" chips, i.e., chips having substantially similar shape as weight chip 28 but without having a specific gravity higher than the specific gravity of the sole. Dummy chips can be made out of polymeric materials with specific gravities substantially lower than that of the sole of the club head. Preferably, each dummy chip has a mass that is less than about 20% of a mass of the weight chip that is replaced.

Weight chip 28 preferably comprises a material having a density greater than the density of the material comprising sole 12. Alternatively, weight chip 28 may comprise the same material as sole 12, however having a greater thickness than the average thickness of sole 12. In other words, the weight per unit area or the "basis weight" of weight chip 28 is greater than that of sole 12. Weight chip 28 may comprise metals, e.g. titanium, stainless steel, or tungsten. Alternatively, weight chip 28 may comprise composite or polymeric material with or without high specific gravity fillers or flakes, such as tungsten or metal powders. Weight chip 28 alternatively comprises any material having a density appropriate to optimize any desired mass property including the location of the center of gravity in terms of height and depth and the various components of moment of inertia ($I_{shaft}$, $I_{xx}$, $I_{zz}$ and $I_{yy}$). By concentrating mass in weight chip 28, weight chip 28 increases the moment of inertia of the club head relative to a club head having a sole with constant density. The areas of higher density or greater thickness, i.e., higher weight per unit area or higher basis weight, may occupy all or part(s) of weight chip 28. Such areas can be referred to as areas of concentrated mass, discussed further below.

Preferably, the basis weight of weight chip 28 (or portions thereof) is at least about 1.5 times the basis weight of sole 12, more preferably at least about two times and most preferably at least three times the basis weight of sole 12.

As shown in FIG. 3, projection 40 of weight chip 28 may comprise a material having a lower density or mass relative to the density or mass of body 29. Docking station 30 may also comprise a lightweight material and may have a density or mass less than the density or mass of surrounding sole 12. Projection 40 and docking station 30 may comprise such materials as aluminum, titanium, magnesium, stainless steel, composite, or polymeric material.

For purpose of comparison only, the PA of a conventional cylindrical weight insert, such as those illustrated in FIGS. 15 and 19C would be the projection of a cylinder onto a flat plane, which would be a rectangular area. The PA of a screw with a screw head would be the projection of the screw along its length onto a flat plane. The effective thickness of such cylindrical weight insert or screw is the volume of such object divided by the PA.

Preferably, weight chip 28 has a plan area of about 4 $cm^2$ and an effective thickness of about 0.5 cm. More preferably, weight chip 28 has a plan area of about 6 $cm^2$ and an effective thickness of about 0.3 cm. Most preferably, weight chip 28 has a plan area of about 7 $cm^2$ and an effective thickness of about 0.3 cm. Referring to chip ratio of weight chip 28 (plan area/thickness), weight chip 28 preferably has a chip ratio greater than about 8. More preferably, weight chip 28 has a chip ratio greater than about 14, and most preferably, weight chip 28 has a chip ratio greater than about 20. The volume of weight chip 28 refers to the plan area multiplied by the effective thickness, and preferably comprises about 3% or less, preferably about 2% or less, or about 1% or less of the volume of club head 10. Hence, since the USGA maximum volume for driver club heads is 460 cc and the preferred volume for the chip is about 1% volume, the volume of chip 28 should be less than 4.6 cc for driver clubs.

In an alternative embodiment, projection 40 may contain higher density or high specific gravity material, while body 29 may contain lower density or lower specific gravity material. Furthermore, chip 28 may be inserted from the direction from the perimeter of club head toward the center of the club head, as shown, or in the opposite direction, or any other orientation.

The center of gravity and MOI of club head 10 may be optimized, depending on the needs of the golfer, by altering the position of docking station 30 during manufacture. To fabricate a club head having a center of gravity rearward and below the center of hitting face 26 but substantially centered with respect to heel 22 and toe 24 of club head 10, docking station 28 may be located toward the back of sole 12 and centered with respect to the heel and toe. Alternatively, docking station 30, and hence weight chip 28, may be positioned toward toe 24 to create a club head having a tendency to remain open at impact with a golf ball. In another embodiment of the present invention, docking station 30 may be located toward heel 22 so that hitting face 26 has a tendency to be closed upon impact with a golf ball.

Figure 8:
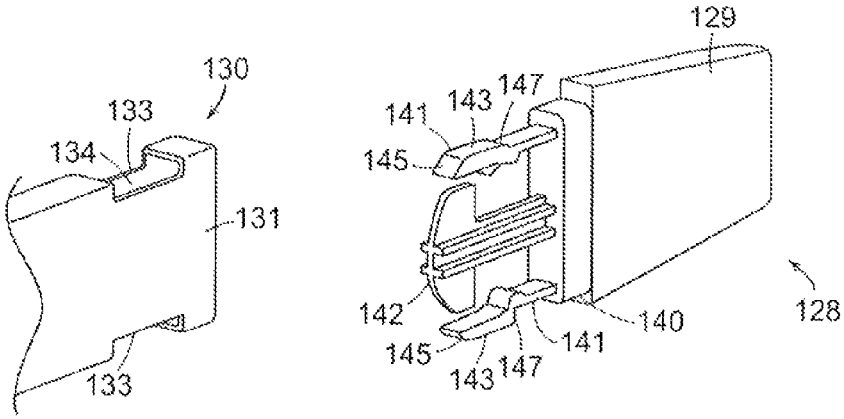
FIGS. 8 and 9 are exploded perspective views of a weight member and receptacle for said weight member, said receptacle shown separated from the sole of a golf club head.

Sole 12 may also comprise more than one weight chip 28. For instance, two weight chips may be positioned at the back of sole 12, one toward the heel and one toward the toe. In another embodiment, three or more weight chips may be utilized. Preferably, the weight chips attach to sole 12 via the attachment mechanism illustrated in FIGS. 1-6. Alternatively, the weight chip may attach to sole 12 via the assemblies taught below and in FIGS. 8 and 9. As stated above, one or more weight chip 28 could be un-weighted, i.e., a dummy chip. A place holder or a cap can be deployed in unused docking stations 30.

In another embodiment, shown in FIG. 20, a golf club head 60 includes a sole 62, a crown (not shown), a back 66, a hosel 68, a skirt 70, a heel 72, a toe 74, a hitting face 76 and a plurality of docking stations 80*a*, 80*b*, 80*c*. Each of the docking stations 80 is configured as a shallow cavity that receives either a weight chip 78 or a dummy chip 79 that is fixedly attached thereto. Preferably, weight chips 78 and dummy chips 79 are configured to be interchangeable in each docking station 80. More preferably, the plan shape and attachment configuration of all of the weight chips 78 and/or dummy chips 79 attached to the golf club head are substantially identical and the weight chips and any dummy chips may have any shape. Examples of alternative shaped weight chips and dummy chips are illustrated in FIGS. 21 and 22. In FIG. 21, the weight chips 81 and dummy chips 82 have an amorphous shape, but the components are identical so that they may be interchangeable in each docking station. Additionally, in FIG. 22, the weight chips 83 and dummy chips 84 have polygonal shapes, but are also identical so that they are interchangeable.

Each of the docking stations 80 is preferably located based on a predetermined relationship to a location of the projected center of gravity of the club head, without weight chips 78, on sole 62. For example, docking station 80*a* is positioned toe ward along the x-axis of club head 60 from the projected location of the center of gravity on sole 62, also referred to herein as the "projected CG location". Preferably, the center of the docking station is located more than 25% of the maximum width of the golf club head in the direction of the x-axis from the projected CG location. Docking station 80*b* is positioned heel ward along the x-axis of club head 60 from the projected CG location. Docking station 80*c* is positioned toward back 66 along the z-axis of club head 60 from the projected CG location. Preferably each of the docking stations 80 is positioned so that the respective axis from the projected CG location extends through a portion of the docking station 80. More preferably, the docking stations 80 are positioned so that at least 20% of the plan surface area of the respective docking station 80 is positioned on each side of the respective axis.

In accordance with this embodiment, weight chip 78 has a plan area of less than about 25 $cm^2$. More preferably, weight chip 78 has a plan area of less than about 20 $cm^2$. Most preferably, weight chip 78 has a plan area of less than about 15 $cm^2$. Weight chip 78 has a thickness of about 0.25 cm or less. More preferably, weight chip 78 has a thickness of about 0.20 or less. Preferably, the volume of weight chip 78 is less than about 1% of the volume of the club head, or less than about 4.6 cc for a driver having a volume of 460 cc. Additionally, weight chip 78 is preferably flexible so that it may be easily conformed to the shape of a mounting surface included in docking station 80. For example, weight chip 78 preferably has a flexural modulus of less than about 100 ksi, and more preferably less than about 20 ksi.

The weight chips of the present invention may be constructed from any material, or combination of materials, that provides the desired density and flexibility. For example, the weight chips may be constructed from polymeric materials, such as tungsten loaded polyurethane, alone or in combination with metallic materials, such as aluminum, steel, lead, etc. Additionally, any of the attachment structures described herein may be used to attach the weight chips and/or dummy chips, including plug-type connectors and/or adhesives.

Tables 2 and 3 provide analyses of the change in the location of the center of gravity of the golf club including a single 15 g weight chip 78 located at each of the three locations of docking stations 80. In particular, the golf club head has a mass, without weight chip 78, of about 182 g. In Table 2, the weight chip 78 has a surface area of about 23 $cm^2$ and a thickness of about 1.6 mm. In Table 3, the weight chip 78 is constructed of a material having a greater density than that of Table 2, and a surface area of about 11.5 $cm^2$ and a thickness of about 1.6 mm. As shown in Tables 2 and 3, by increasing the density of the material of the weight chip so that the mass is more concentrated in a discrete location, more significant changes in the location of the center of gravity in the direction of the heel and toe may be accomplished.

TABLE 2

| Docking Station Location of 15 g | Delta X | Delta Y | Delta Z |
|---|---|---|---|
| Toe | −4.0 | −0.8 | −0.5 |
| Heel | 2.3 | −1.4 | −0.6 |
| Back | −0.3 | −1.4 | −3.9 |

TABLE 3

| Docking Station Location of 15 g | Delta X | Delta Y | Delta Z |
|---|---|---|---|
| Toe | −4.3 | −0.6 | 0.0 |
| Heel | 2.8 | −1.2 | 0.1 |
| Back | −0.1 | −1.6 | −3.8 |

The impact on the trajectory of a struck golf ball is provided in Table 4. The described trajectories illustrate the impact of moving the center of gravity by the amounts described in Table 3 as compared to a golf club having the 15 g distributed evenly in the sole. The trajectory information was determined using computer modeling of a golf club striking a golf ball having the physical properties and behavior of a Titleist ProV1 golf ball.

TABLE 4

| Location of 15 g | Ballspeed (mph) | Launch Angle (deg) | Backspin (rpm) | Sidespin (rpm) | Carry Dist. (yd) | Carry Dispersion (yd) | Total Dist. (yd) | Total Dispersion (yd) |
|---|---|---|---|---|---|---|---|---|
| Original | 163.0 | 8.3 | 2570 | −8 | 263.6 | 4.4 | 285.8 | 4.8 |
| Toe | 163.1 | 8.3 | 2574 | −238 | 263.1 | 9.8 | 285.3 | 11.4 |
| Heel | 162.7 | 8.4 | 2448 | 169 | 261.2 | −1.9 | 285.0 | −2.8 |
| Back | 163.0 | 8.4 | 2493 | −24 | 262.9 | 6.0 | 285.9 | 6.6 |

One advantage of the weight chip of the present invention is that it can be utilized to control the swing weight of the clubs in the set. Swing weight is related to the weight of a club head and to the length of the shaft. For example, a 3-iron may weigh 240 grams while a wedge may weigh 290 grams, but since the shaft of the 3-iron is longer than the shaft of the wedge both clubs may have the same swing weight. It is preferred that the swing weights for a set of irons are substantially similar. Weight chips 28 can be utilized in irons to adjust the swing weight of iron clubs. Weight chips 28 can also be used to adjust the swing weight of a driver, e.g., by changing a chip of 1 gram for a chip of 4 grams.

In accordance with this invention, other means of attaching a removable weight member to sole 12 may be utilized. In one embodiment, illustrated in FIG. 8, removable weight chip 128 and docking station 130 (shown separated from sole 12) may comprise a side-release buckle mechanism, such as the one taught in U.S. Pat. No. 4,150,464, which is incorporated herein by reference in its entirety. Exemplary removable weight chip 128 includes body 129 and projection 140, which comprises resilient arms 141 and rigid arm 142 situated between resilient arms 141. Resilient arms 141 further comprise raised lateral edges 143 and leading edges 145. Docking station 130 comprises housing 131 in which cavity 134 resides. Housing 131 further comprises slots 133. As weight chip 128 is pushed into cavity 134, leading edges 145 meet housing 131 and cause resilient arms 141 to compress slightly, allowing resilient arms 141 to be pushed further into cavity 134. Weight chip 128 is securely attached to docking station 130 once raised lateral edges 143 enter slots 133. Resilient arms 141 decompress and return to their normal position. Trailing edges 147 meet the edge of slots 133 and prevent weight chip 128 from sliding out of docking station 130. Body 129 may include a dovetail to engage dovetail receptacle 32 of sole 12. Weight chip 128 may be released from housing 131 by depressing resilient arms 141, exposed at raised lateral edges 143 through slots 133, while pulling rearward on body 129. This method of attachment is substantially the same as the "buckle" attachments for backpacks and the like.

Figure 9:
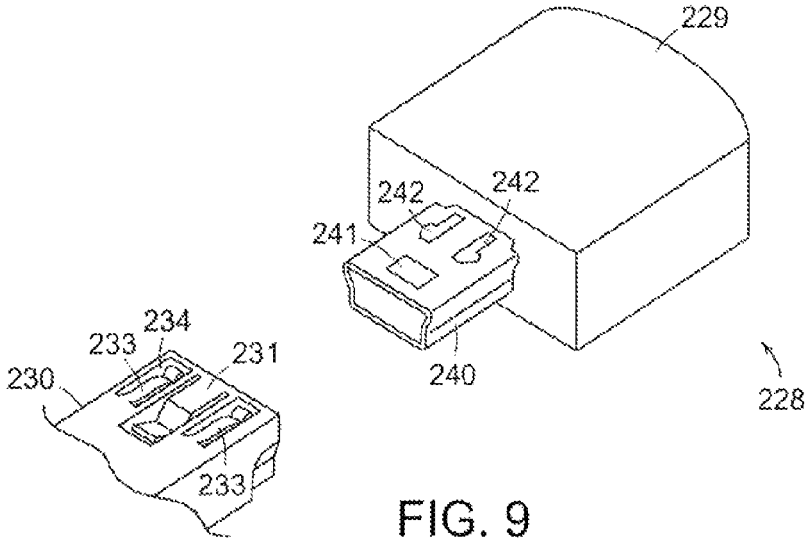

In another embodiment of the present invention, shown in FIG. 9, removable weight chip 228 and docking station 230 mate as in a universal-serial-bus (USB) electronic connection assembly. An example of such a connection assembly is taught in U.S. Pat. No. 6,902,432. In accordance with this embodiment, weight chip 228 comprises body 229 and projection 240. Docking station 230 (shown separated from sole 12) comprises cavity 234, central tongue 231 and lateral tongues 233. Cavity 234 is slightly larger than projection 240 so that projection 240 may be inserted into cavity 234. As projection 240 is pushed into cavity 234, the inclined planes of central tongue 231, which form a "v" shaped depression, enter opening 241 of projection 240. Simultaneously, the inclined planes of lateral tongues 233 enter slots 242. The mating of central tongue 231 to opening 241 and lateral tongues 233 to slots 242 create a secure but releasable connection between weight chip 228 and docking station 230. Body 229 may include a dovetail to engage dovetail receptacle 32 of sole 12. Alternatively, for USB connections the chip may comprise a memory device such as EEPROM, EPROM or flash drive to store information relating to the impacts between club and balls. In one example, a sensor measuring torque and/or vibration can be inserted into the club head, preferably at the hitting face and measurements from the sensor can be written on the memory device through the USB connection by a controller. The chip can be removed and attached to a reader, such as a laptop or smart phone and the data can be conveyed to the golfer. High torque or high vibration may indicate off-center hits, and statistical analysis can be provided to the golfer. A suitable sensor can be a piezoelectric device comprising an accelerometer, described and claimed in commonly-owned, co-pending patent application Ser. No. 11/979,787 filed on Nov. 8, 2007, which is incorporated by reference in its entirety.

Other suitable attachment mechanisms include those described in or can be derived from commonly owned, co-pending patent application Ser. No. 11/563,224 filed on Nov. 27, 2006, which is incorporated herein by reference in its entirety.

Figure 16:
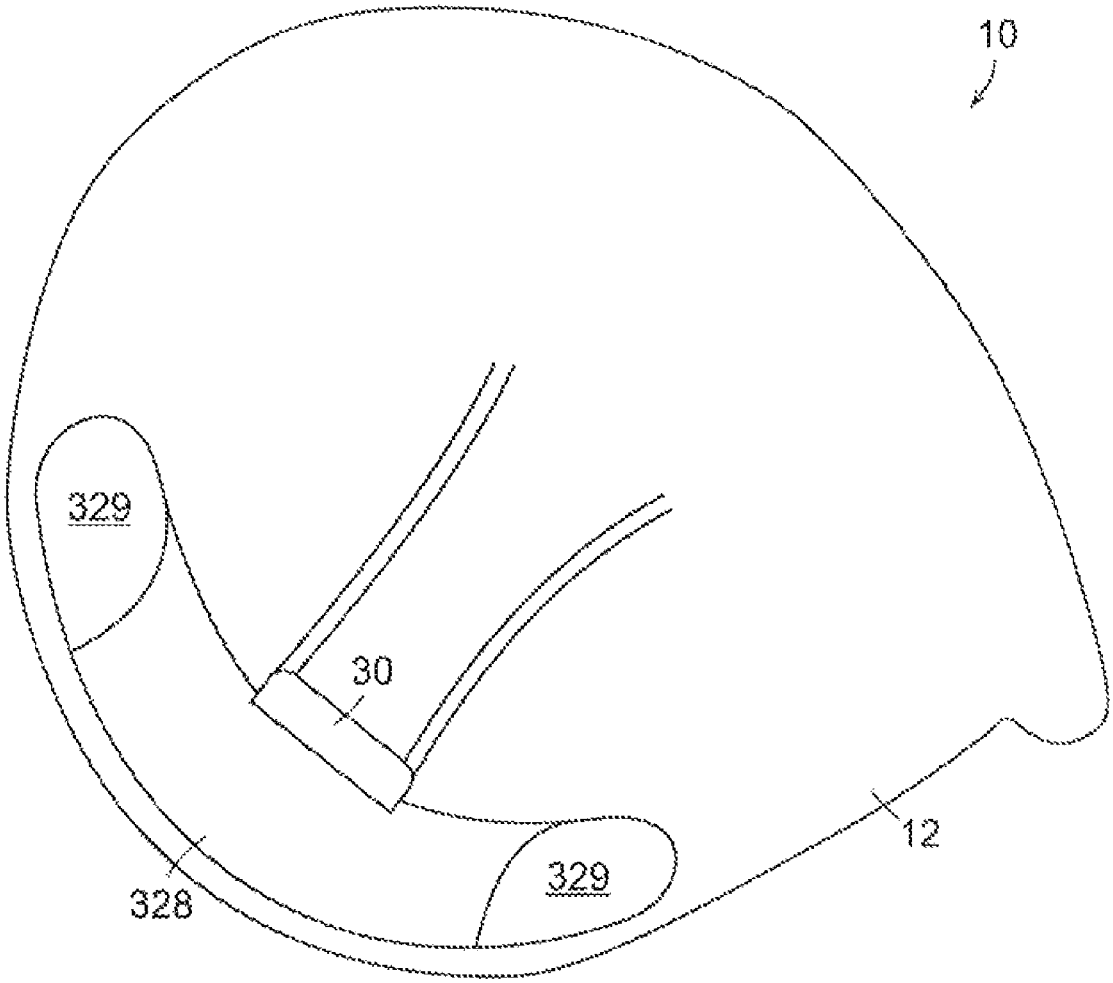
FIG. 16 is a top plan view of a golf club head of the present invention including a removable weight member.

In accordance with yet another embodiment of the present invention, sole 12 may comprise a removable weight member which has a varied mass and/or density over its plan area (PA). Referring to FIG. 16, weight chip 328 comprises a substantial portion of the back of sole 12. It is shaped such that its average length (measure in the heel-toe direction) is much greater than its average width (measured in the back-hitting face direction) so that mass is concentrated on the periphery of sole 12. Weight chip 328 includes areas 329 having greater density or basis weight than the rest of weight chip 328. In this embodiment, areas 329 are situated on the heel and toe ends of weight chip 328. In other embodiments, weight chip 328 may comprise one, two or more areas 329 of concentrated mass. Further, areas 329 may be situated at any location on weight chip 328, depending on the desired mass characteristics of golf club head 10, discussed above. In accordance with this embodiment, weight chip 328 has a plan area of about 10 $cm^2$ to about 50 $cm^2$. More preferably, weight chip 328 has a plan area of about 20 $cm^2$ to about 40 $cm^2$ and more preferably about 25 $cm^2$ to about 35 $cm^2$. Weight chip 328 preferably has an effective thickness of about 0.30 cm or less. More preferably, weight chip 328 has an effective thickness of about 0.25 cm or less. Most preferably, weight chip 328 has an effective thickness of about 0.20 cm or less. Preferably, the volume of the chip remains less than about 3%, more preferably less than about 2% or less than about 1% of the volume of the club head, e.g., less than about 4.6 cc, for a driver club head.

Figure 2:
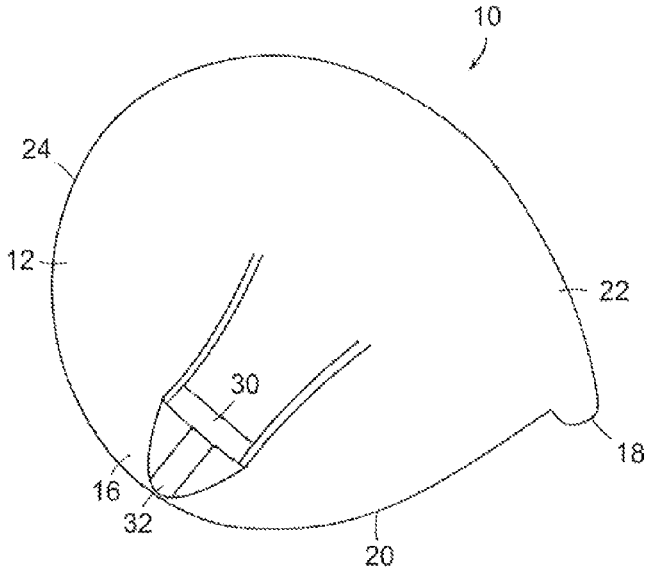
FIG. 2 is a bottom plan view of the golf club head of FIG. 1, however with the weight member removed.
Figure 17:
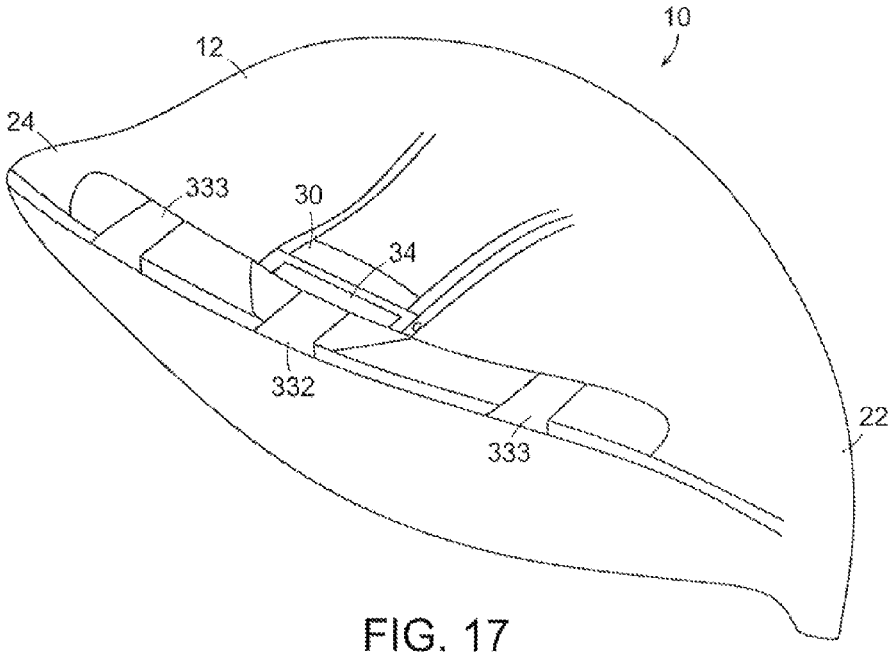
FIG. 17 is a perspective view of a golf club head of FIG. 16, however with the weight member removed.

To securely attach weight chip 328 to golf club head 10, sole 12 may comprise an attachment mechanism similar to that shown in FIGS. 1, 2 and 6. As shown in FIG. 17, sole 12 may comprise docking station 30 including cavity 34 to receive projection 40 of weight chip 328. Projection 40 and docking station 30 operate in the same fashion as illustrated FIGS. 1-6. Sole 12 may further comprise central dovetail receptacle 332 and peripheral dovetail receptacles 333 to engage central dovetail 338 and peripheral dovetails 339 on weight chip 328, as shown in FIG. 18.

Figure 18:
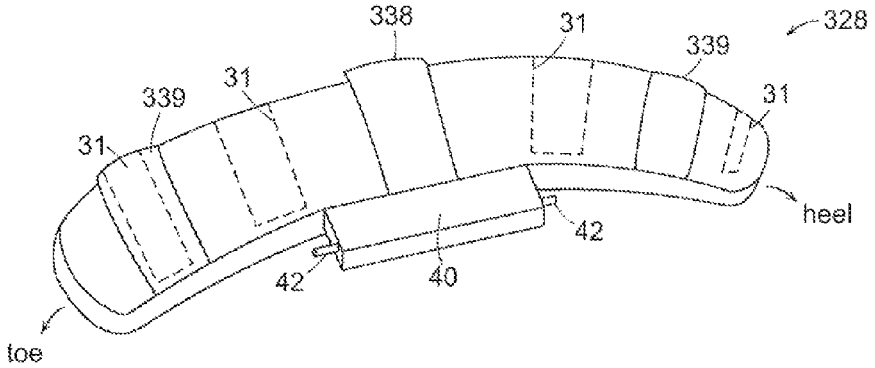
FIG. 18 is a perspective view of the weight member shown in FIG. 16.

In another embodiment of the present invention, chip 28, 128, 228 and 328 may contain one or more pockets 31, shown in phantom lines in FIGS. 3 and 18. Each of these pockets is sized and dimensioned to receive a concentrated weight that has a density or basis weight higher than those of the sole. Pockets 31 can have any shape, rectangular prism, diamond prism, cylindrical, etc. One advantage of this embodiment is that individual golfers may tailor the mass characteristics, discussed above, of their clubs to their own personal standards. For example, referring to FIG. 17 a golfer may choose to insert concentrated weights into pockets 31 that proximate the toe to increase MOI and swing weight and leave pockets 31 closer to the heel unused, and vice versa.

The club head may be formed by any means known to those skilled in the art. For instance, portions of the club head may be formed from cast, forged, stamped, or molded components. Any material known to those skilled in the art may be used including, but not limited to, iron, steel, aluminum, tin, vanadium, chromium, cobalt, nickel, magnesium, or alloys. In a preferred embodiment, the face, the sole, the face plate, and the support members may comprise a high strength titanium alloy such as 10-2-3 (Ti-10% V-2% Fe-3% Al) or 15-3-3-3 (Ti-15% V-3% Cr-3% Sn-3% Al). In another embodiment, the face, the sole, the face plate, and/or the support members may be produced from a different titanium alloy such as a 6-4 alloy (Ti-6% Al-4% V).

In alternate embodiments, other forging and casting alloys may be used, such as stainless steel and aluminum. By forming the face plate by stamping, forging, or casting, the face portion may be thin yet still have sufficient strength to withstand repeated impact with a golf ball without failure. In turn, by forming the face portion as thin as possible while still meeting the desired mechanical performance standards, weight may be redistributed to other parts of the club head.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A golf club head comprising a hosel, face, crown, skirt, and sole, wherein the sole comprises a plurality of weight cavities and at least a first compliant weight member coupled to a first of the plurality of weight cavities, wherein at least a portion of said first compliant weight member has a basis weight greater than that of the sole, and the first compliant weight member comprises a non-threaded attachment mechanism, wherein said first compliant weight member has a flexural modulus of less than 100 ksi, such that the shape of the first compliant weight member conforms to the first of the plurality of weight cavities, and wherein the first compliant weight member is shaped to complement the shape of the first of the plurality of weight cavities.

2. The golf club head of claim 1, wherein the first compliant weight member has a plan shape that is polygonal.

3. The golf club head of claim 1, wherein the first compliant weight member has a flexural modulus of less than 20 ksi.

4. The golf club head of claim 1, wherein the first compliant weight member has a chip ratio, defined as the plan area of the first compliant weight member divided by the effective thickness of the first compliant weight member, of greater than about 8, wherein the plan area is a maximum amount of a two-dimensional surface that can be projected onto a plane defined by a longitudinal axis and width axis of the first compliant weight member and the effective thickness is the volume of the first removable weight member divided by the plan area.

5. The golf club head of claim 4, wherein a mounting surface of the weight docking station is non-planar.

6. The golf club head of claim 1, wherein the sole further comprises at least a first compliant dummy member coupled to a second of the plurality of weight docking stations, wherein the first compliant dummy member has a mass of less than 20% of a mass of the first compliant weight member.

7. The golf club head of claim 6, wherein the sole further comprises a second compliant dummy member coupled to a third of the plurality of weight docking stations, wherein the second compliant dummy member has a mass of less than 20% of a mass of the first compliant weight member.

8. The golf club head of claim 1, wherein at least one of the plurality of weight docking stations extends from the sole and onto the skirt.

9. The golf club head of claim 8, wherein each of the plurality of weight docking stations extends from the sole and onto the skirt.

10. The golf club of claim 8, wherein the plurality of weight cavities includes a toe weight cavity, a heel weight cavity and a back weight cavity.

11. The golf club head of claim 1, wherein the volume of the first compliant weight member is less than about 1% of the volume of the club head.

12. The golf club of claim 1, wherein the basis weight of said at least a portion of said first compliant weight member is at least about 1.5 times the basis weight of the sole.

13. The golf club of claim 12, wherein the basis weight of said at least a portion of said first compliant weight member is at least about two times the basis weight of the sole.

14. The golf club of claim 13, wherein the basis weight of said at least a portion of said first compliant weight member is at least about three times the basis weight of the sole.

15. A golf club head comprising a hosel, face, crown, skirt, and sole, wherein the sole comprises a plurality of weight cavities and at least a first compliant weight member coupled to a first of the plurality of weight cavities, wherein at least one of the plurality of weight cavities includes a non-planar mounting surface, wherein at least a portion of said first compliant weight member has a basis weight greater than that of the sole, and the first compliant weight member comprises a non-threaded attachment mechanism, and wherein said first compliant weight member is flexible such that the shape of the first compliant weight member conforms to the non-planar mounting surface.

16. The golf club head of claim 15, wherein the first compliant weight member has a chip ratio, defined as the plan area of the first compliant weight member divided by the effective thickness of the first compliant weight member, of greater than about 8, wherein the plan area is a maximum amount of a two-dimensional surface that can be projected onto a plane defined by a longitudinal axis and width axis of the first compliant weight member and the effective thickness is the volume of the first removable weight member divided by the plan area.

17. The golf club head of claim 16, wherein said removable weight member has a chip ratio greater than about 14.

18. The golf club head of claim 17, wherein said removable weight member has a chip ratio greater than about 20.

* * * * *